US005598761A

United States Patent [19]

Kristensen et al.

[11] Patent Number: 5,598,761

[45] Date of Patent: Feb. 4, 1997

[54] HYDRAULIC AXIAL PISTON MACHINE WITH CONTROL FACE LOCATED IN REAR FLANGE AND FRICTION-REDUCING PLASTIC INSERT IN REAR FLANGE

[75] Inventors: Egon Kristensen, Nordborg; Sten J. Olesen, Sønderborg, both of Denmark

[73] Assignee: Danfoss A/S, Nordborg, Denmark

[21] Appl. No.: 550,449

[22] Filed: Oct. 30, 1995

[30] Foreign Application Priority Data

Nov. 30, 1994 [DE] Germany ..... 44 42 556.2

[51] Int. Cl.[6] ..... F01B 13/04

[52] U.S. Cl. ..... 92/57; 92/71; 417/269; 74/60

[58] Field of Search ..... 92/57, 71; 417/269; 74/60; 91/499

[56] References Cited

U.S. PATENT DOCUMENTS 4,142,450 3/1979 Thoma ..... 91/485

5,279,205 1/1994 Carlson, Jr. et al. ..... 91/499

*Primary Examiner*—Thomas E. Denion

*Attorney, Agent, or Firm*—Lee, Mann, Smith, McWilliams, Sweeney & Ohlson

[57] ABSTRACT

A hydraulic axial piston machine (1) is disclosed, having a cylinder drum (2) which is mounted rotatably in a housing and comprises at least one cylinder (3) which, on rotation of the cylinder drum (2), passes over control kidneys (15) in a control face. In order to be able to operate such a machine even with hydraulic fluid that has no or only slight lubricating properties, such as, for example, water, and in order to be able to manufacture the machine with few manufacturing steps, the control face is located on the rear flange (9) of the housing, and the control kidneys (15) are formed in a plastics material insert (10) which is arranged in the rear flange (9) of the machine (1).

8 Claims, 2 Drawing Sheets

Figure 2:
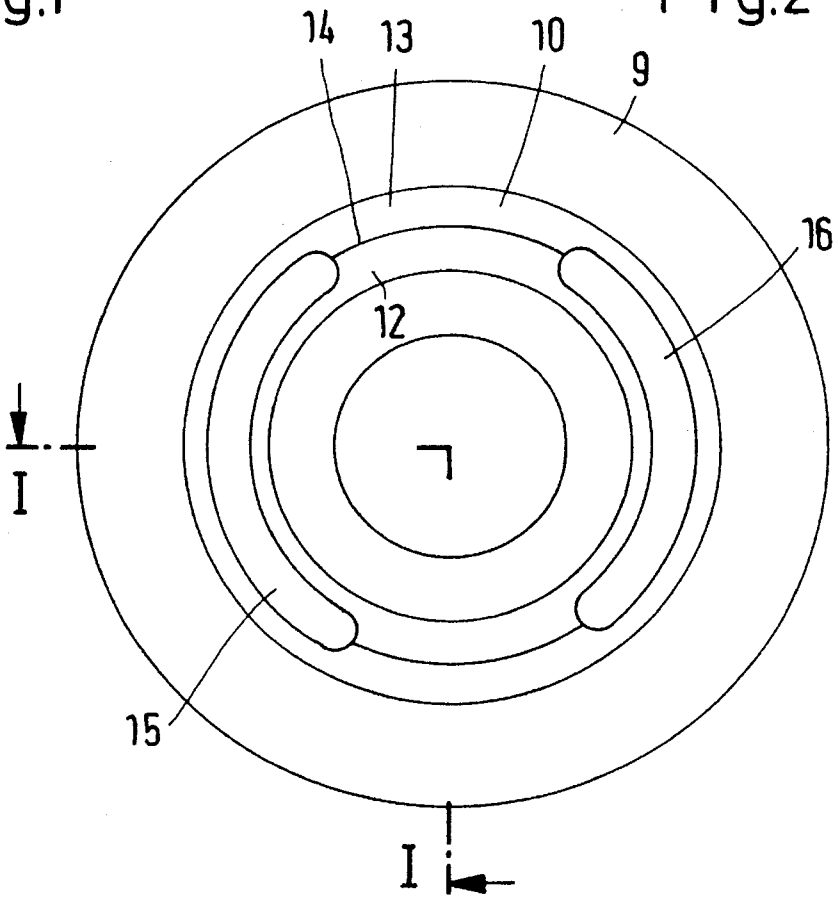

116
110
109
121
115
III
III 101
109
110
103
102
104
106
108
115
111
121

HYDRAULIC AXIAL PISTON MACHINE WITH CONTROL FACE LOCATED IN REAR FLANGE AND FRICTION-REDUCING PLASTIC INSERT IN REAR FLANGE

The invention relates to a hydraulic axial piston machine having a cylinder drum which is mounted rotatably in a housing and comprises at least one cylinder which, on rotation of the cylinder drum, passes over control "kidneys" in a control face.

In such machines, as are known, for example, from DE 37 25 361 A1, the cylinder drum has to be pressed with a relatively strong pressure against the control face, which is also known as the control plate, in order to keep the transition from the cylinder or cylinders to the control face as well-sealed as possible. The larger are the unsealed areas, the greater is the leakage, which has an adverse effect on the volumetric efficiency of the machine. On the other hand, such a high pressure between the cylinder drum and the control face naturally increases the friction, which, without supplementary measures, leads relatively quickly to wear and tear or even to destruction of the machine.

This phenomenon can be partially counteracted by lubrication between cylinder drum and control face. The hydraulic fluid has hitherto widely been used for that purpose. This presupposes, however, that the hydraulic fluid has satisfactory lubricating properties. This requirement considerably restricts the group of hydraulic fluids that can be used. Fluids which have satisfactory lubricating properties, for example, most of the known synthetic hydraulic oils, are in many cases harmful from the point of view of their impact on the environment. Most synthetic hydraulic oils are toxic.

In another known machine, (DE 43 01 133 A1), the control face has therefore been arranged on a control plate body which is provided at least in the region of the control face with a thin layer of a friction-reducing plastics material. To fix the friction-reducing layer permanently to the control face, or to the control plate body, a series of structural measures have to be taken which make manufacture of such a machine complicated.

The invention is therefore based on the problem of constructing a hydraulic axial piston machine in a simple manner such that it can be operated even with a hydraulic fluid that has no or only slight lubricating properties, for example, with water.

In a machine of the kind mentioned in the introduction, this problem is solved in that the control face is located on the rear flange of the housing, and the control kidneys are formed in a plastics material insert which is arranged in the rear flange of the machine.

The control face therefore forms a part of the surface of the rear flange of the housing. In this manner it is possible to avoid, firstly, an additional separate part, namely, the control plate body. That body has hitherto been required in order to be able to achieve the necessary precision during machining of the control face. The control plate body was able to be manufactured with increased accuracy as a small part compared with the remainder of the housing of the machine. Because a plastics material insert which is arranged in the rear flange of the machine in an annular channel is now being used, two advantages are achieved. Firstly, the plastics material, which for this purpose is in the form of a friction-reducing plastics material, enables the lubricating function which has hitherto been provided by the hydraulic fluid to be guaranteed. Secondly, when using such a plastics material insert, accurate machining of the control face is not necessary. On the contrary, only the seat for the insert has to be made in the control face. This can be effected, however, with correspondingly less precision. Only the plastics material insert requires to be manufactured with relatively high precision. Since, however, the plastics material is easier to machine than metal, this presents no great problems. Because the plastics material insert is now arranged in the rear flange of the housing, it is also adequately supported against the pressure forces. In the rear flange of the housing there is sufficient material available, or more accurately, sufficient metal, to support the plastics material insert. Notwithstanding the use of a non-lubricating hydraulic fluid, for example, water, the machine can therefore be of simpler construction in this region, yet is nevertheless reliably operable.

On the side of the insert remote from the cylinder drum there is preferably provided at least one relief channel. A pressure which forces the insert out of the rear flange or squeezes it between the rear flange and the cylinder drum is thus prevented from being able to build up between the rear flange and the insert. The relief channel thus extends the service life by reducing stresses on the insert. The relief channel is preferably formed by a circumferential recess on the insert. Because it consists of plastics material, the insert is easier to machine than the rear flange itself. In addition, by this feature the relief channel is located exactly where it is needed, namely, at the insert.

In a preferred construction, the relief channel is connected by way of at least one duct to the inside of the housing. In the inside of the housing the prevailing pressure is normally ambient pressure or tank pressure, so that any fluid which may have entered the relief channel is easily able to flow away here.

The insert preferably projects beyond the rear flange towards the cylinder drum. In this manner it is possible to ensure with great reliability that the cylinder drum rubs only against the insert and not against the rear flange. The extent to which the insert projects beyond the rear flange can be kept small. It need only be sufficiently large for contact between cylinder drum and rear flange to be avoided.

In an especially preferred construction, the insert is of annular construction and divided in the radial direction. It therefore consists, as it were, in the radial direction of an inner ring and an outer ring. As a result of the annular construction, the cylinder drum is presented with a closed annular surface which is interrupted only by the control kidneys. Problems that could arise as a result of transitions or steps are therefore excluded from the outset. With such inserts it has been shown that the plastics material insert will break under extreme loads under the influence of the high forces that then occur; the break point can be kept under control only with difficulty. The radial division anticipates this break point so to speak.

In an additional or alternative constructions between the control kidneys the insert can have a reinforcing core which is surrounded by a thin layer of plastics material. The insert thereby receives a greater strength so that the probability that the forces occurring will lead to breaks or other damage is kept smaller.

A pressure plate is preferably arranged between the insert and the cylinder drum. In considering the part of the hydraulic machine on which the present invention is based, such a pressure plate can be regarded as part of the cylinder drum. The pressure plate allows better balancing of the forces acting on the cylinder drum.

Figure 1:
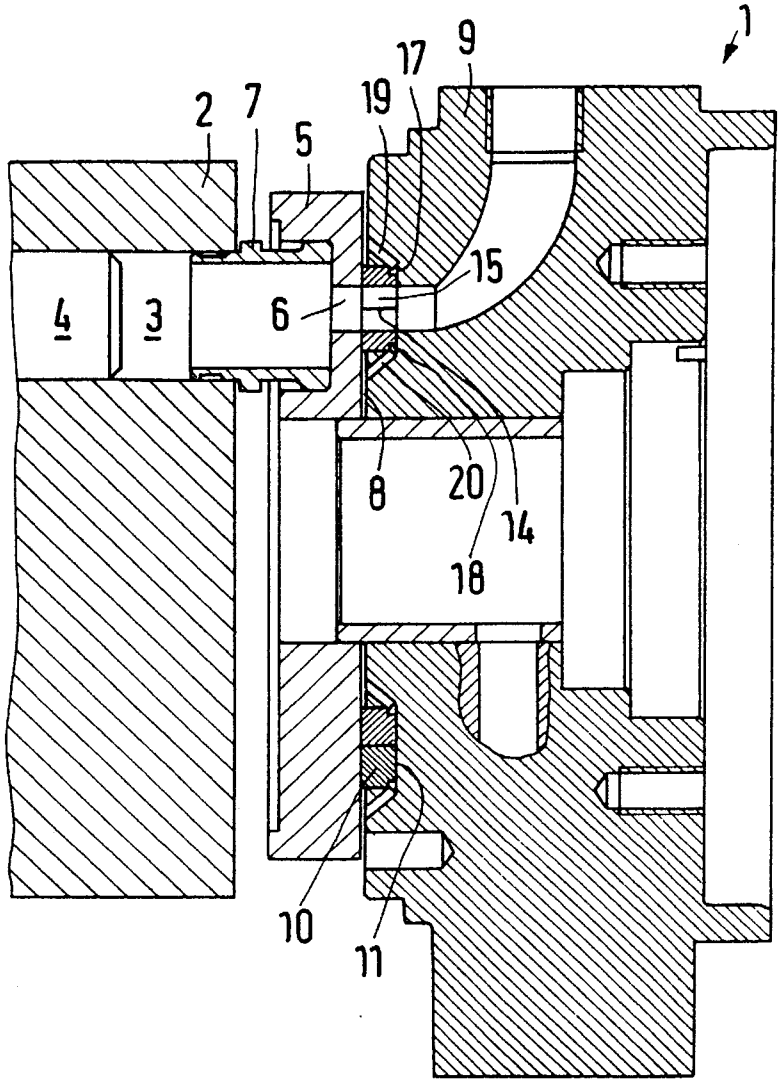
Figures 3, 4:
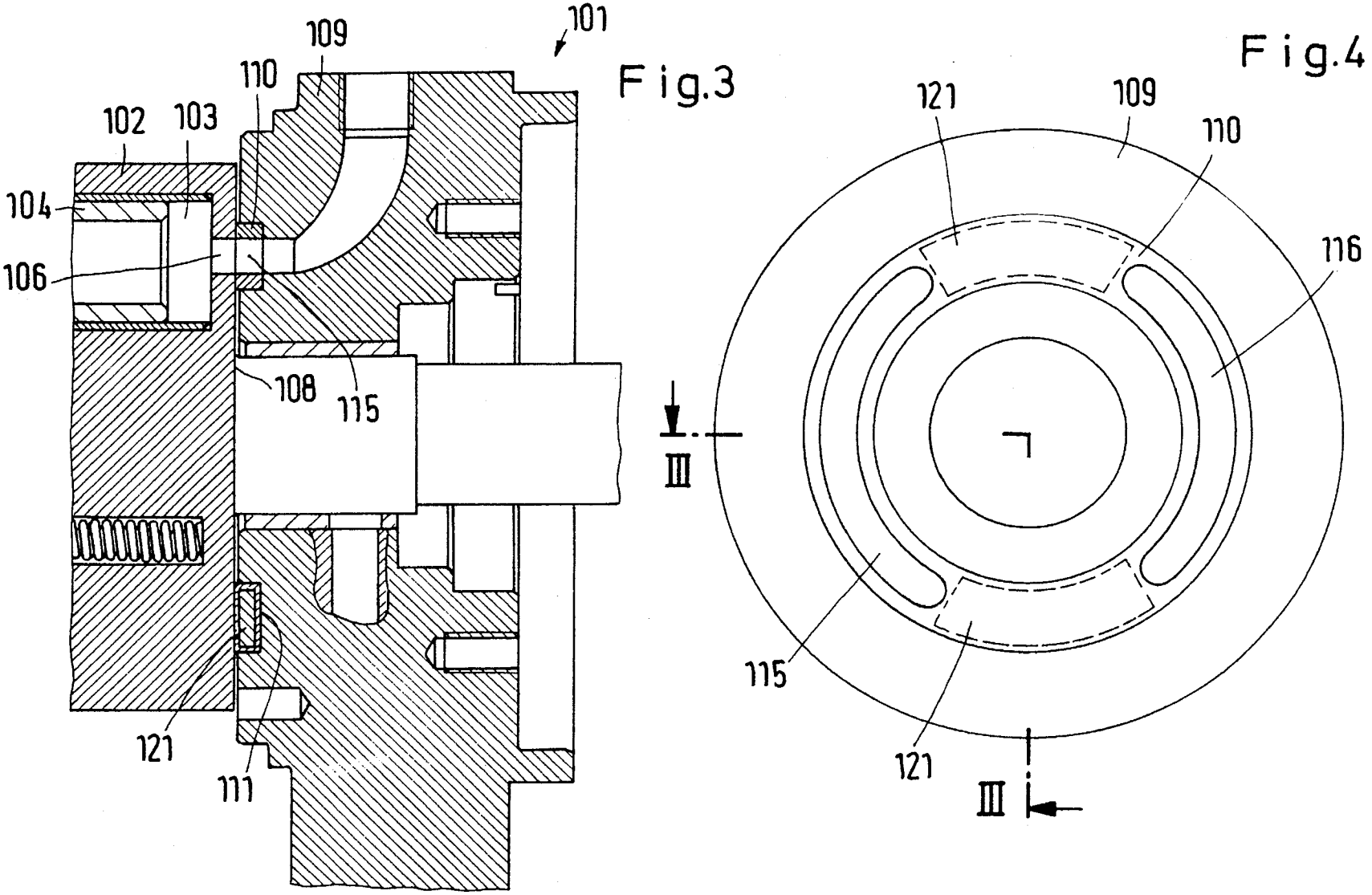

The invention is described hereinafter with reference to two preferred embodiments in conjunction with the drawings, in which FIG. 1 shows a first embodiment of a hydraulic machine in section approximately along the line I—I shown in FIG. 2, FIG. 2 is a plan view of a rear flange, FIG. 3 shows a second construction of a hydraulic machine approximately in the section III—III shown in FIG. 4, and FIG. 4 is a plan view of the rear flange of the hydraulic machine shown in FIG. 3.

A hydraulic machine 1 has a cylinder body 2, in which a cylinder 3 is arranged. A piston 4 is arranged to move back and forth in the cylinder 3. The movement of the piston 4 in the cylinder 3 is controlled, in a manner that is known and not here explained, by way of a slanting plate, on which the piston bears at the end not illustrated by means of a slide shoe.

At the end of the cylinder drum 2 that is shown, there is provided a pressure plate 5 which has a through-opening 6 for each cylinder 3. The pressure plate 5 is joined by way of plug-in bushes 7 to the cylinder drum 2 so that a fluid-tight transition between the through-opening 6 and the associated cylinder 3 is possible. For the purposes of the following explanation, the pressure plate 5 should be regarded as part of the cylinder drum 2.

The pressure plate 5 has a contact face 8 which faces towards a rear flange 9, that is, a housing part, of the hydraulic machine 1. The contact face 8 does not rest against the rear flange 9, however, but only against an insert 10 which is inserted in an annular channel 11 in the rear flange 9. The insert 10 consists of a friction-reducing plastics material. Suitable plastics material for the insert is in particular a material from the group of high-strength thermoplastic plastics materials based on polyarylether ketones, in particular polyether ether ketones (PEEK), polyamides, polyacetalenes, polyaryl ethers, polyethylene terephthalates, polyphenylene sulphides, polysulphones, polyether sulphones, polyether imides, polyamideimides, polyacrylates, phenol resins, such as novolak resins, or similar substances; glass, graphite, polytetrafluoroethylene or carbon, especially in fibre form, can be used as fillers.

The insert 10 projects somewhat from the rear flange 9. In the drawing, the extent of the projection is shown exaggeratedly large. The projection is necessary only to a height which is sufficient so that the contact face 8 of the pressure plate 5 does not come into contact with the rear flange 9 itself.

By virtue of this construction, the insert 10 is largely surrounded by the material of the rear flange 9, which normally consists of iron or another metal, so that it is adequately supported, even at the considerable pressure forces which can act upon it, and cannot become deformed to an appreciable extent.

The insert 10 is divided in two in the radial direction, as apparent from FIG. 2. It consists therefore of an inner part 12 and a radially outer part 13 which are separated from one another by a joint 14. This joint 14 forms, as it were, a predetermined break point, so that differences in axial forces which can act on different radial regions of the insert 10 do not lead to damage of the insert 10.

In the insert 10 there are arranged two control kidneys 15, 16, which come alternately into connection with the cylinder 3 on rotation of the cylinder drum 2 and pressure plate 5. One control kidney acts here as the inlet opening whilst the other acts as the drain opening. Such control kidneys are known per se and are therefore not discussed further.

As is evident from FIG. 1, radially inside and radially outside on the insert 10 there is a respective relief channel 17, 18, the radial outer relief channel 17 being connected by way of an opening 19 and the radially inner relief channel 18 being connected by way of an opening 20 to the inside of the housing, not shown, of the hydraulic machine 1. Several such openings 19, 20 can, of course, be provided, distributed in the circumferential direction. Hydraulic fluid which somehow finds its way between the insert 10 and the rear flange 9 is able to escape through the respective relief channel 17, 18 and the opening 19, 20 into the inside of the housing, so that no pressure is able to build up between the insert 10 and the rear flange 9. The relief channels 17, 18 are formed in the embodiment illustrated by providing the insert 10 at its end inserted in the rear flange 9 with annular recesses which, together with the channel 11, form the corresponding relief channels 17, 18.

The insert 10 is secured in the rear flange 9 against rotation. As the means safeguarding against rotation there may be provided, for example, a projection which is inserted in a recess. Alternatively, it is possible to secure the insert 10 in the housing with a press fit.

FIG. 3 shows a second construction, which omits the pressure plate. Corresponding parts are provided with reference numbers increased by 100.

This construction of the hydraulic machine 101 omits the pressure plate. The cylinder drum 102 has at the output of the cylinder 103 the through-opening 106 which is in direct connection by way of the contact face 108 with the insert 110. The insert, as in the construction according to FIG. 1 also, projects somewhat from the rear flange 109 of the machine 101.

The insert 110 of this embodiment is not divided into two. Instead, it has a core 121 of metal, which is arranged between the control kidneys 115, 116 and serves to reinforce the insert 110. The core 121 is shown by broken lines in FIG. 4. More precisely, there are two cores in the two gaps between the two control kidneys 115, 116. Of course, the metal core 121 can also extend over the entire circumference of the insert 110, that is, can extend past the control kidneys 115, 116. A radial division of the insert is also feasible, in which also the core 121 can then be radially divided.

An embodiment which has a core 121 can, of course, also be divided in the radial direction. It is equally possible to use the insert 110 in the construction shown in FIGS. 1 and 2, and likewise to use the insert 10 in the construction shown in FIGS. 3 and 4.

Relief channels 17 and 18 are also needed in the construction shown in FIGS. 3 and 4, but they are not shown here. In that case, the cylinder drum 102 can be pressed against the insert 110 in the rear flange 109 of the machine with such force that the pressure built up by incoming fluid would not be sufficient to damage the insert 110 or force it out of the rear flange 109.

As is apparent from FIG. 1, the area of the insert 10 which is exposed to leakage oil pressure from the rear flange 9, that is, which is inserted in the rear flange 9, is smaller than the area which lies opposite the pressure plate 5. The difference in area is formed by the areas of the relief channels 17, 18. No pressure is able to build up there because the pressure prevailing in the relief channels 17, 18 is tank pressure or the pressure inside the housing. The forces exerted on the insert 10 by the leakage oil pressures are in total directed so that the insert 10 is held fixedly in the rear flange 9. The same area relationship obtains in the construction according to FIGS. 3 and 4.

We claim:

1. A hydraulic axial piston machine having a cylinder drum which is mounted rotatably in a housing and comprises at least one cylinder which, on rotation of the cylinder drum, passes over control kidneys in a control face, the control face being located on a rear flange of the housing, and the control kidneys having a plastic material insert which is arranged in the rear flange of the machine.

2. A machine according to claim 1, in which there is provided at least one relief channel on a side of the insert remote from the cylinder drum.

3. A machine according to claim 2, in which the relief channel is formed by a circumferential recess on the insert.

4. A machine according to claim 2, in which the relief channel is connected by way of at least one duct to the inside of the housing.

5. A machine according to claim 1, in which the insert projects beyond the rear flange towards the cylinder drum.

6. A machine according to claim 1, in which the insert is of annular construction and divided in a radial direction.

7. A machine according to claim 1, in which between the control kidney the insert has a reinforcing core which is surrounded by a thin layer of plastic material.

8. A machine according to claim 1, including a pressure plate arranged between the insert and the cylinder drum.

* * * * *